US008051815B2

(12) United States Patent
Maehara et al.

(10) Patent No.: US 8,051,815 B2
(45) **Date of Patent: *Nov. 8, 2011**

(54) ENGINE

(75) Inventors: Hayato Maehara, Saitama (JP); Shinji Saito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 536 days.

This patent is subject to a terminal disclaimer.

(21) Appl. No.: 12/035,454

(22) Filed: Feb. 22, 2008

(65) Prior Publication Data

US 2008/0202458 A1 Aug. 28, 2008

(30) Foreign Application Priority Data

Feb. 27, 2007 (JP) ..... 2007-047560

(51) Int. Cl.
*F01L 1/34* (2006.01)

(52) U.S. Cl. ..... 123/90.16; 123/90.48

(58) Field of Classification Search ..... 123/90.16, 123/90.48, 90.52

See application file for complete search history.

(56) References Cited

U.S. PATENT DOCUMENTS

| | | | | |
|---|---|---|---|---|
| 5,564,373 | A * | 10/1996 | Hara | 123/90.16 |
| 6,076,491 | A * | 6/2000 | Allen | 123/90.16 |
| 2006/0081213 | A1 * | 4/2006 | Yang et al. | 123/321 |
| 2006/0213470 | A1 * | 9/2006 | Maehara et al. | 123/90.16 |

FOREIGN PATENT DOCUMENTS

JP 10-184327 A 7/1998

* cited by examiner

*Primary Examiner* — Zelalem Eshete

(74) *Attorney, Agent, or Firm* — Birch, Stewart, Kolasch & Birch, LLP

(57) ABSTRACT

A valve stopping mechanism wherein when hydraulic fluid pressure is low a cylinder operating state is set and a response of a switch from a cylinder stop state to the cylinder operating state is high. An intake valve and an exhaust valve, a first intake valve spring and a first exhaust valve spring are provided for energizing the valves in the direction of closing the valves, valve drive cams, valve stopping mechanisms, on the basis of a stop hydraulic fluid pressure and energization of plunger springs, for selectively generating valve operating and valve stop states. The valve stopping mechanism generates the operating state when the energizing force of the plunger spring is larger than the press force of the stop hydraulic fluid pressure and generates the stop state when the press force of the stop hydraulic fluid pressure is larger than the energizing force of the plunger spring.

21 Claims, 9 Drawing Sheets

ENGINE

CROSS-REFERENCE TO RELATED APPLICATIONS

The present application claims priority under 35 USC 119 to Japanese Patent Application No. 2007-047560 filed on Feb. 27, 2007 the entire contents of which are hereby incorporated by reference.

BACKGROUND OF THE INVENTION

1. Field of the Invention

The present invention relates to an engine having a valve stopping mechanism capable of stopping operation of intake/exhaust valves for opening/closing a communication part between an engine cylinder chamber and an intake or exhaust path.

2. Description of Background Art

An engine is known having a valve stopping mechanism for stopping the operation of a part or all of intake/exhaust valves in a state where a valve drive cam rotates in accordance with an operating state of the engine.

As such a valve stopping mechanism, there is a configuration disclosed in JP-A No. H10-184327 wherein the valve stopping mechanism includes a lifter 11*a* which is reciprocated in a valve opening/closing direction by a valve drive cam 7, a lifter spring 24 for energizing the lifter 11*a* so that the lifter 11*a* abuts on the valve drive cam 7, and a plunger 23 sliding in a cylinder hole 21*a* formed extending at the right angle with the opening/closing direction in the lifter. In the plunger 23, a through hole 23*b* in which a valve shaft 5*a* of an exhaust valve 5 can be inserted and a power transmission face 23*g* on which the tip of the valve shaft 5*a* abuts are formed.

In the valve stopping mechanism, when the lifter 11*a* is reciprocated by the valve drive cam 7 in a state where the plunger 23 energized by the plunger spring 25 is moved to a stop position, the valve shaft 5*a* is inserted in a through hole 23*a*, and the exhaust valve 5 is held closed irrespective of the reciprocating movement of the lifter 11*a*, thereby obtaining a cylinder stop state. On the other hand, when the plunger 23 receives hydraulic fluid pressure on the side opposite to the plunger spring 25, the plunger 23 moves to the operating position against energization of the plunger spring 25. In this state, when the lifter 11*a* is reciprocated by the valve drive cam 7, the valve shaft 5*a* abuts on the power transmission face 23*g* and is reciprocated together with the lifter 11*a*, and the exhaust valve 5 is opened/closed, thereby obtaining a cylinder operating state.

In such a related valve stopping mechanism, the plunger 23 moves to the stop position by being energized by the plunger spring 25 and moves to the operating position by receiving hydraulic fluid from the opposite side. With this configuration, on start of an engine or the like, it takes time for the hydraulic fluid to become larger than the energizing force of the plunger spring. During the time, the valve is not opened/closed, and the cylinder stop state is obtained. Consequently, there is a problem such that it is difficult to obtain a sufficiently large engine output. To be concrete, for example, in the case of driving a hydraulic pump by an engine and generating the hydraulic fluid from a discharge of the hydraulic pump, when the engine is operated at very low speed on start of the engine or the like, it takes time for the hydraulic fluid to become large. During the time, the cylinder stop state is obtained. There is a problem such that it is difficult to increase an engine output.

To improve the steering feel for the driver, it is also requested to promptly switch from a valve stop state to a valve operating state by hydraulic control in response to a request for increasing an engine output of the driver, that is, to promptly switch from a cylinder stop state (state where the valve stops and the cylinder does not operate) to a cylinder operating state (state where the valve is opened/closed and the cylinder operates).

SUMMARY AND OBJECTS OF THE INVENTION

According to an embodiment of the present invention, an engine having a valve stopping mechanism capable of setting a cylinder operating state by opening/closing a valve in accordance with rotation of a crankshaft when hydraulic fluid is low at the time of start of an engine or the like is provided wherein an excellent response of switch from a cylinder stop state to the cylinder operating state is realized.

According to an embodiment of the present invention, an engine includes an intake valve 20 and an exhaust valve 30 provided for a cylinder head of the engine. A valve energizing member, for example, a first intake valve spring 24*a* and a first exhaust valve spring 34*a* are provided for energizing the valve in the direction of closing the valve. A valve drive cam is rotated in correspondence with rotation of a crankshaft of the engine. A valve stopping mechanism is provided between the valve drive cam and the valve and, on the basis of a stop hydraulic fluid pressure supplied from the outside and an operation energizing member, for example, plunger springs 47 and 57, for generating an energizing force against the stop hydraulic fluid pressure, selectively generating an operating state of opening/closing the valve in response to an operation of the valve drive cam and a stop state of holding the valve in a valve closing position irrespective of the operation of the valve drive cam. A stop hydraulic fluid pressure supply controller is provided for controlling supply of the stop hydraulic fluid pressure. The valve stopping mechanism generates the operating state when the energizing force of the operation energizing member is larger than the press force of the stop hydraulic fluid pressure, and generates the stop state when the press force of the stop hydraulic fluid pressure is larger than the energizing force of the operation energizing member The stop hydraulic fluid pressure supply controller includes a switching member, for example, a spool valve 85, which can be moved between a hydraulic fluid supply position in which a pressure source path is connected to a pressure source for supplying the stop hydraulic fluid pressure and a stop pressure supply path for supplying the stop hydraulic fluid pressure to the valve stopping mechanism are communicated with each other. A hydraulic fluid discharging position for closing the pressure source path and making the stop pressure supply path communicate with the drain side is provided together with a switching energizing member, for example, a spool spring 86, for energizing the switching member to move to the hydraulic fluid supply position side. A switching pressure supply control mechanism, for example, a solenoid mechanism 90, applies a pressure force to move the switching member to the hydraulic fluid discharge position side.

In the engine having such a configuration, preferably, the switching pressure supply control mechanism is constructed by a solenoid valve and, when a solenoid is energized, applies the pressure force to move the switching member to the hydraulic fluid discharge position side.

In the engine, preferably the valve stopping mechanism includes a holder, for example, plunger holders 41 and 51, reciprocated in the direction of opening/closing the valve by the valve drive cam. A stop selecting member, for example, stop selecting plungers 45 and 55, is provided in the holder that is capable of moving between an operating position to open/close the valve in accordance with a reciprocating operation of the holder and a stop position to hold the valve in a valve close position irrespective of the reciprocating operation of the holder. The operation energizing member energizes the stop selecting member to the operation position side, and the stop selecting member which receives the stop hydraulic fluid pressure is pressed to the stop position side against the energizing force of the energizing member.

In this case, preferably, the valve includes a valve body for opening/closing the communication part and a valve stem connected to the valve body and extending toward the valve stopping mechanism. The tip of the valve stem passes through the holder and faces the stop selecting member. In the stop selecting member, a stem abutment face and a stem receiving part are formed. When the stop selecting member is in the operating position, the stem abutment face abuts on the tip of the valve stem and moves the valve in the open/close direction together with the holder. When the stop selecting member is in the stop position, the tip of the valve stem is fit in the stem receiving part, and the stem receiving part moves the holder but maintains the valve closed. The stem abutment face and the stem receiving part are formed adjacent to each other in the direction of moving the stop selecting member, and the stop hydraulic fluid pressure is received on the side opposite to the stem abutment face in the direction of moving the stop selecting member while sandwiching the stem receiving part.

Further, preferably, in the stop selecting member, an energizing member housing part for housing the operation energizing member is formed on the same side as the side on which the stem abutment face is formed in the movement direction of the stop selecting member, and a stem communication hole via which the energizing member housing part and the stem housing part communicate with each other is provided in a position overlapping the stem abutment face in the movement direction.

In the engine having the configuration, the holder may be pressed via a rocker arm which swings by being pressed by the valve drive cam, and reciprocate in the direction of opening/closing the valve. The holder may be disposed in a bottomed cylindrical valve lifter, thereby constructing the valve stopping mechanism, and the valve lifter may be pressed by the valve drive cam so as to reciprocate in the direction of opening/closing the valve together with the holder.

With the engine of the present invention, the valve stopping mechanism is constructed to generate the operating state when the energizing force of the operation energizing member is larger than the press force of the stop hydraulic fluid pressure, and generates the stop state when the press force of the stop hydraulic fluid pressure is larger than the energizing force of the operation energizing member. When the engine is operated at very low speed at the time of start of the engine or the like and the stop hydraulic fluid pressure is low, a valve operating state is generated, and a cylinder operating state is obtained. Consequently, a large engine output can be obtained with reliability as a cylinder operating state upon the start of the engine.

In the stop hydraulic fluid pressure supply controller, the switching member is moved to the hydraulic fluid supply position side by the energizing force of the switching energizing member, and the pressure force is applied from the switching pressure supply control mechanism to move the hydraulic fluid discharge position side. Consequently, at the time of switching the cylinder stop state to the cylinder operating state, the pressure force is applied from the switching pressure supply control mechanism and a control of moving the switching member to the hydraulic fluid discharge position is performed. Since the control of forcedly moving the switching member by using the pressure force is performed, a control of promptly moving the switching member to the hydraulic fluid discharge position can be performed, and the response of a switch from the cylinder stop state to the cylinder operating state can be improved. Consequently, in the case such that the driver performs an operation of opening the throttle in the cylinder operating state, the state is promptly switched to the cylinder operating state, and the response to a request for increasing an engine output can be improved.

In the engine, preferably, the switching pressure supply control mechanism is constructed by a solenoid valve and, when a solenoid is energized, a control of applying the pressure force so as to move the switching member to the hydraulic fluid discharge position side is performed. With this configuration, the cylinder operating state and the cylinder stop state can be easily switched by the control of passing current to the solenoid.

In the engine, preferably, the valve stopping mechanism includes a holder reciprocated by the valve drive cam and a stop selecting member capable of moving between an operating position to open/close the valve in accordance with the reciprocating operation of the holder and a stop position to hold the valve in a valve close position irrespective of the reciprocating operation of the holder. The operation energizing member energizes the stop selecting member to the operation position side, and the stop selecting member which receives the stop hydraulic fluid pressure is pressed to the stop position side against the energizing force of the energizing member. With such a configuration, the operation control of setting the valve stopping mechanism in the stop position or the operating position on the basis of the balance between the energizing member and the stop hydraulic fluid pressure can be performed easily and reliably.

In this case, in the stop selecting member, a stem abutment face and a stem receiving part are formed. When the stop selecting member is in the operating position, the stem abutment face abuts on the tip of the valve stem and moves the valve in the open/close direction together with the holder. When the stop selecting member is in the stop position, the tip of the valve stem is fit in the stem receiving part, and the stem receiving part moves the holder but maintains the valve closed. The stem abutment face and the stem receiving part are formed adjacent to each other, and the stop hydraulic fluid pressure is received on the side opposite to the stem abutment face. With this configuration, in the stop selecting member, the stem abutment face for receiving the press force from the valve stem and the portion for receiving the stop hydraulic fluid pressure are apart from each other via the stem receiving part. Consequently, the influence of the press force acting from the valve stem to the stem abutment face, exerted on the part of receiving the stop hydraulic fluid pressure is suppressed. Therefore, deformation of the portion for receiving the stop hydraulic fluid pressure is small, the sealing performance of the portion is maintained excellent, and durability can be improved.

Further, in the stop selecting member, when the energizing member housing part is formed on the same side as the side on which the stem abutment face is formed, and a stem communication hole is provided in a position overlapping the stem abutment face, the stem communication hole becomes longer, the weight of the stop selecting member can be reduced by that amount, and response at the time of moving the stop selecting member improves. Thus, the weight of the whole valve stop mechanism is reduced.

The configuration can be applied to the valve opening/closing mechanism of the rocker arm driving type in which the holder is reciprocated via a rocker arm. The configuration can be also applied to a valve opening/closing mechanism of a cam direct driving type in which a holder is disposed in a valve lifter and the valve lifter is pressed by a valve drive cam and is reciprocated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
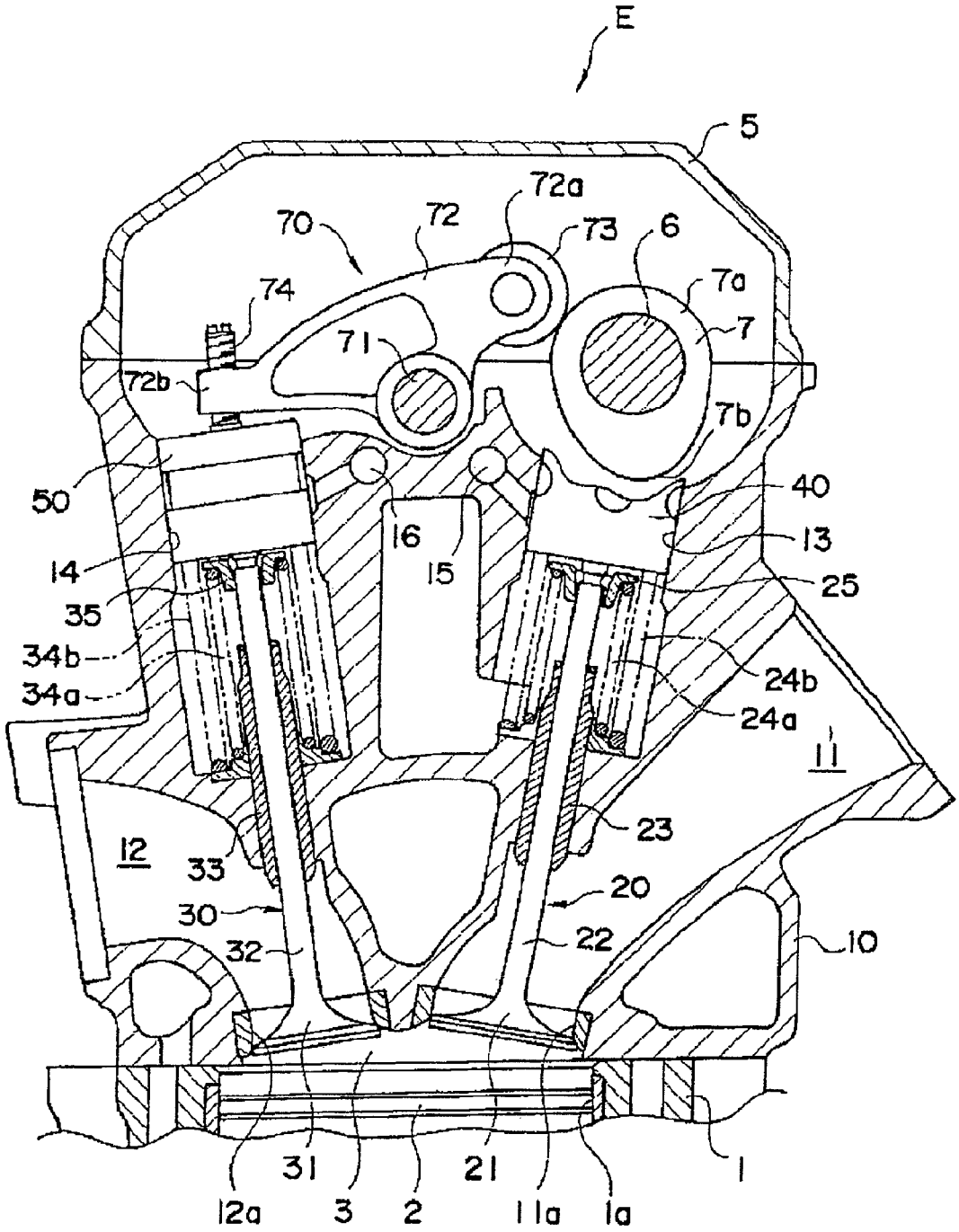
FIG. 1 is a cross section showing the structure of a peripheral portion of a cylinder head in an engine to which the present invention is applied.

Preferred embodiments of the present invention will be described hereinbelow with reference to the drawings. FIG. 1 shows a structure of a portion of a cylinder head in a four-stroke engine E to which the present invention is applied. The engine E is a multi-cylinder engine, and a cross section of only one of the cylinders is shown. A piston 2 is slidably disposed in a cylinder hole 1*a* of a cylinder block 1 as a component of the cylinder. The piston 2 is coupled to an engine crankshaft via a connecting rod to rotate the engine crankshaft in accordance with reciprocation of the piston 2. Since the configuration is not directly related to the present invention and is a known one, it will not be described.

A cylinder head 10 is coupled to the top face of the cylinder block 1. In a state where the cylinder head 10 is attached, a combustion chamber 3 is formed in a portion surrounded by the cylinder hole 1*a* and facing the top face of the piston 2. An intake path 11 and an exhaust path 12 that communicate with the combustion chamber 3 are formed in the cylinder head 10. In the communication part among the intake path 11, the exhaust path 12, and the combustion chamber 3, an intake valve 20 and an exhaust valve 30 for opening/closing an intake port 11*a* and an exhaust port 12*a* forming the communication part are provided.

The intake valve 20 has a valve body 21 openably closing the intake port 11*a* and a rod-shaped valve stem 22 connected integrally with the valve body 21 and extending therefrom. The valve stem 22 is slidably guided by a cylindrical stem guide 23 attached to the cylinder head 10, and the intake valve 20 is slidable in the extension direction of the valve stem 22. The tip of the valve stem 22 is energized in the valve closing direction (upward direction in the diagram) by a first intake valve spring (valve energizing member) 24*a* via a retainer 25. In a free state, the valve body 21 closes the intake port 11*a*.

Similarly, the exhaust valve 30 has a valve body 31 openably closing the exhaust port 12*a* and a rod-shaped valve stem 32 connected integrally with the valve body 31 and extending therefrom. The valve stem 32 is slidably guided by a cylindrical stem guide 33 attached to the cylinder head 10, and the exhaust valve 30 is movable in the extension direction of the valve stem 32. The tip of the valve stem 32 is energized in the valve closing direction (upward direction in the diagram) by a first exhaust valve spring (valve energizing member) 34*a* via a retainer 35. In a free state, the valve body 31 closes the exhaust port 12*a*.

In the cylinder head 10, a guide hole 13, extending coaxially from the attachment part of the stem guide 23 for the intake valve 20 to the upper side (outside), is formed so as to penetrate to the top face side. An intake valve stopping mechanism 40 is disposed slidable in the axial direction in the guide hole 13. On the top face side of the cylinder head 10, a camshaft 6 is disposed so as to extend in the crankshaft direction (direction perpendicular to the drawing face), and an intake valve drive cam 8 provided for the camshaft 6 faces the top end of the intake valve stopping mechanism 40 (refer to FIGS. 9 and 10). The intake valve stopping mechanism 40 is energized to the camshaft direction (toward the upper side in the drawing) by a second intake valve spring 24*b* disposed in the guide hole 13, and the upper end face of the intake valve stopping mechanism 40 is in contact with cam faces 8*a* and 8*b* of the intake valve drive cam 8.

Similarly, a guide hole 14 extending coaxially from the attachment part of the stem guide 33 for the exhaust valve 30 to the upper side (outside) is formed so as to penetrate to the top face side. An exhaust valve stopping mechanism 50 is disposed slidable in the axial direction in the guide hole 14. On the top face side of the cylinder head 10, a rocker arm mechanism 70 having a rocker arm 72 slidably supported by a supporting shaft 71 so as to extend in the crankshaft direction (direction perpendicular to the drawing face) is provided. A cam follower 73 is rotatably attached to one end (right end) 72*a* of the rocker arm 72, and the cam follower 73 abuts on cam faces 7*a* and 7*b* of an exhaust valve drive cam 7 provided for the camshaft 6. A press member 74 is attached to the other end 72*b* of the rocker arm 72, and the lower end of the press member 74 faces the upper end of the exhaust valve stopping mechanism 50. The press member 74 is screwed in the other end 72*b* of the rocker arm 72. By adjusting the screw amount, the amount of downward projection can be adjusted. Consequently, a groove 74*a* to which a driver or the like is inserted is formed in the upper end of the press member 74.

The exhaust valve stopping mechanism 50 is energized toward the rocker arm side (toward the upper side in the drawing) by a second exhaust valve spring 34*b* disposed in the guide hole 14, and the upper end face of the exhaust valve stopping mechanism 50 is in contact with the press member 74 to press the press member 74 upward, and the rocker arm 72 is energized so as to swing clockwise in the diagram, thereby making the cam follower 73 abut on the cam faces 7*a* and 7*b* of the exhaust valve drive cam 7.

A cylinder head cover 5 is coupled to the top face of the cylinder head 10 so as to cover the cam shaft 6, the rocker ram mechanism 70, and the like. Although not shown, a spark plug facing the combustion chamber 3 is attached to the cylinder head 10, and an intake pipe connected to the intake path 11 and an exhaust pipe connected to the exhaust path 12 are attached to the cylinder head 10. To the intake pipe, an air cleaner, a throttle valve, a fuel injection valve, and the like are attached, with the air-fuel mixture of fuel and air being supplied to the combustion chamber 3 in accordance with the operation of the engine E. Combustion gas generated in the combustion chamber 3 is exhausted from the exhaust passage 12 to the outside via the exhaust pipe.

In the engine having the above configuration, first, the configuration of opening/closing the exhaust valve 30 via the exhaust valve stopping mechanism 50 by the rocker arm mechanism 70 will be described in detail hereinbelow with reference to FIGS. 2 to 8.

Figure 4:
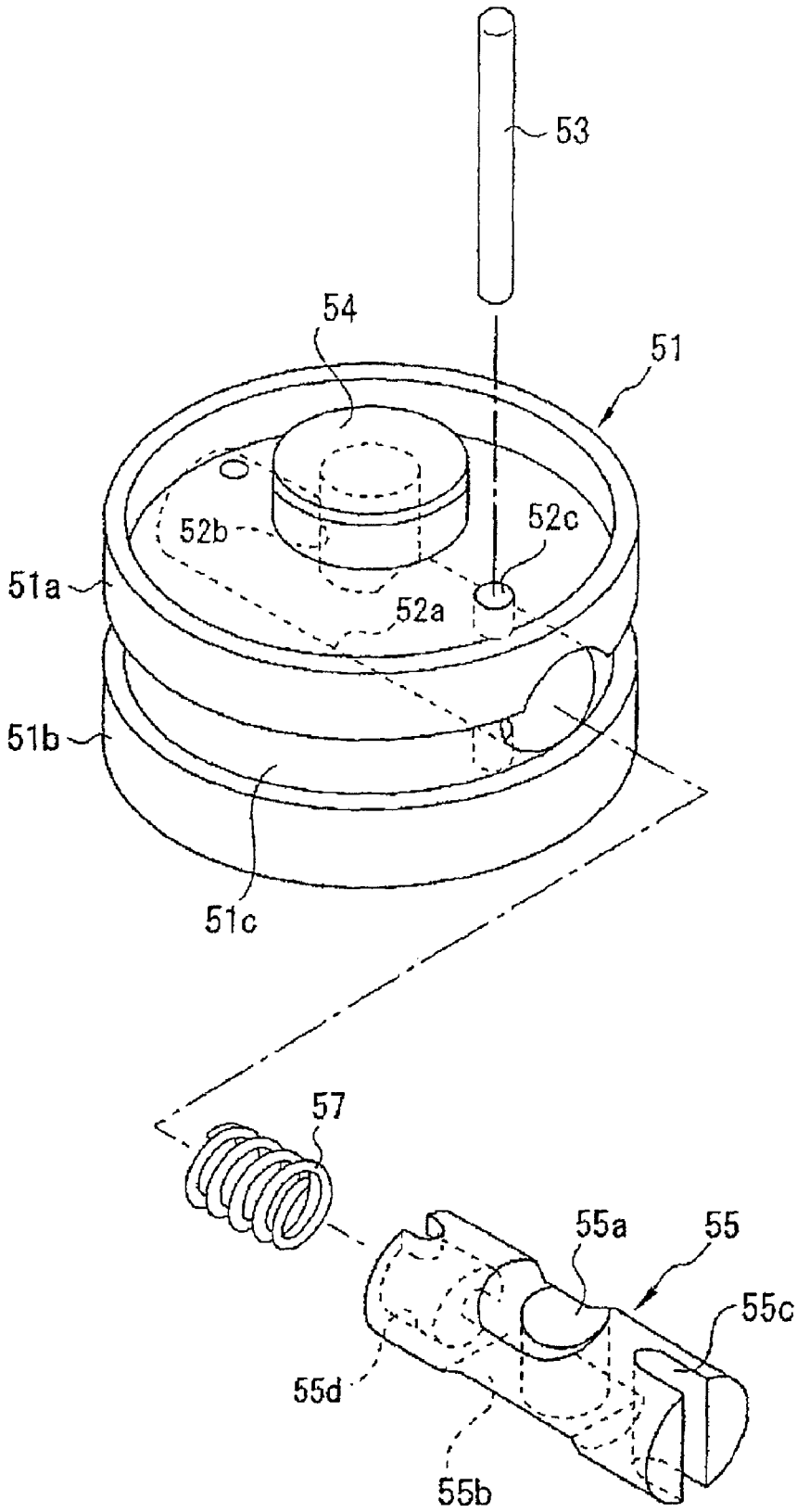
FIG. 4 is an exploded perspective view of members constructing the exhaust valve stopping mechanism.

The exhaust valve stopping mechanism 50 has, as shown in FIG. 4, a plunger holder 51 whose outer shape is formed cylindrically and slidably fit in the guide hole 14, a stop selecting plunger 55 is slidably fit in a plunger hole 52*a* that is formed so as to penetrate the plunger holder 51 in the direction orthogonal to the sliding direction of the plunger holder 51. A plunger spring 57 is provided for energizing the stop selecting plunger 55 to one side in the sliding direction (to the right side in the drawing). In the plunger holder 51, a holder-side stem receiving hole 52*b* penetrating the plunger holder 51 in the vertical direction in the center of the outer cylindrical shape is formed. A disc-shaped abutment plate 54 covering the holder-side stem receiving hole 52*b* is fixed at the upper end. The size of the holder-side stem receiving hole 52*b* is set larger than the diameter of the end of the valve stem 32 of the exhaust valve 30 so that, as will be described later, the tip of the valve stem 32 can project into the holder-side stem receiving hole 52*b*.

One end of the plunger hole 52*a* formed in the plunger holder 51 is open and the other end is closed. The plunger spring 57 is attached into the plunger hole 52*a* so as to abut on the close wall. After that, the stop selecting plunger 55 is slidably fit in the plunger hole 52*a*. In the stop selecting plunger 55, a slit 55*c* extending in the radial direction is formed on one end side in the axial direction (the right end side in the diagram). A spring receiving recess 55d for receiving the plunger spring 57 is formed on the other end side (the left end side in the diagram). Further, a plunger-side stem receiving hole 55*a* extending orthogonally and passing the center of the axis is formed in the center portion in the axial direction. The size of the plunger-side stem receiving hole 55*a* is set larger than the diameter of the end of the valve stem 32 of the exhaust valve 30 so that, as will be described later, the tip of the valve stem 32 can project into the plunger-side stem receiving hole 55*a*. The lower end opening of the plunger-side stem receiving hole 55*a* is cut in a plane, thereby forming a step abutment face 55*b*.

In the plunger holder 51, further, a pin hole 52*c* is formed that is positioned near the open end of the plunger hole 52*a*, crossing the center of the plunger hole 52*a*, and penetrating in the vertical direction. A stopper pin 53 is fit in the pin hole 52*c*. The stopper pin 53 is fit in the slit 55*c* in the stop selecting plunger 55 fit in the plunger hole 52*a*. The stop selecting plunger 55 is pressed to the right side in the diagram by the plunger spring 57, and the bottom of the slit 55*c* abuts on the stopper pin 53 and is held in the position shown in FIG. 2. In the position, rotation of the stop selecting plunger 55 is regulated by the stopper pin 53, the stem abutment face 55*b* is positioned on the under face side, and the plunger-side stem receiving hole 55*a* is positioned deviated from the holder-side stem receiving hole 52*b* in the axial direction. The upper end of the valve stem 32 of the exhaust valve 30 closely faces the step abutment face 55*b*. The position of the stop selecting plunger 55 at this time will be called an operating position.

On the other hand, a ring-shaped hydraulic fluid receiving groove 51*c* is formed in an intermediate portion on the cylindrical peripheral face of the plunger holder 51. A cylindrical upper guide wall 51*a* and a cylindrical lower guide wall 51*b* are formed with the hydraulic fluid receiving groove 51*c* therebetween. When the plunger holder 51 is fit in the guide hole 14, the upper and lower guide walls 51*a* and 51*b* arc guided so as to be slidably fit in the guide hole 14, and the plunger holder 51 can smoothly slide in the guide hole 14. The plunger hole 52*a* is open to the inside of the hydraulic fluid receiving groove 51*c*.

Figure 2:
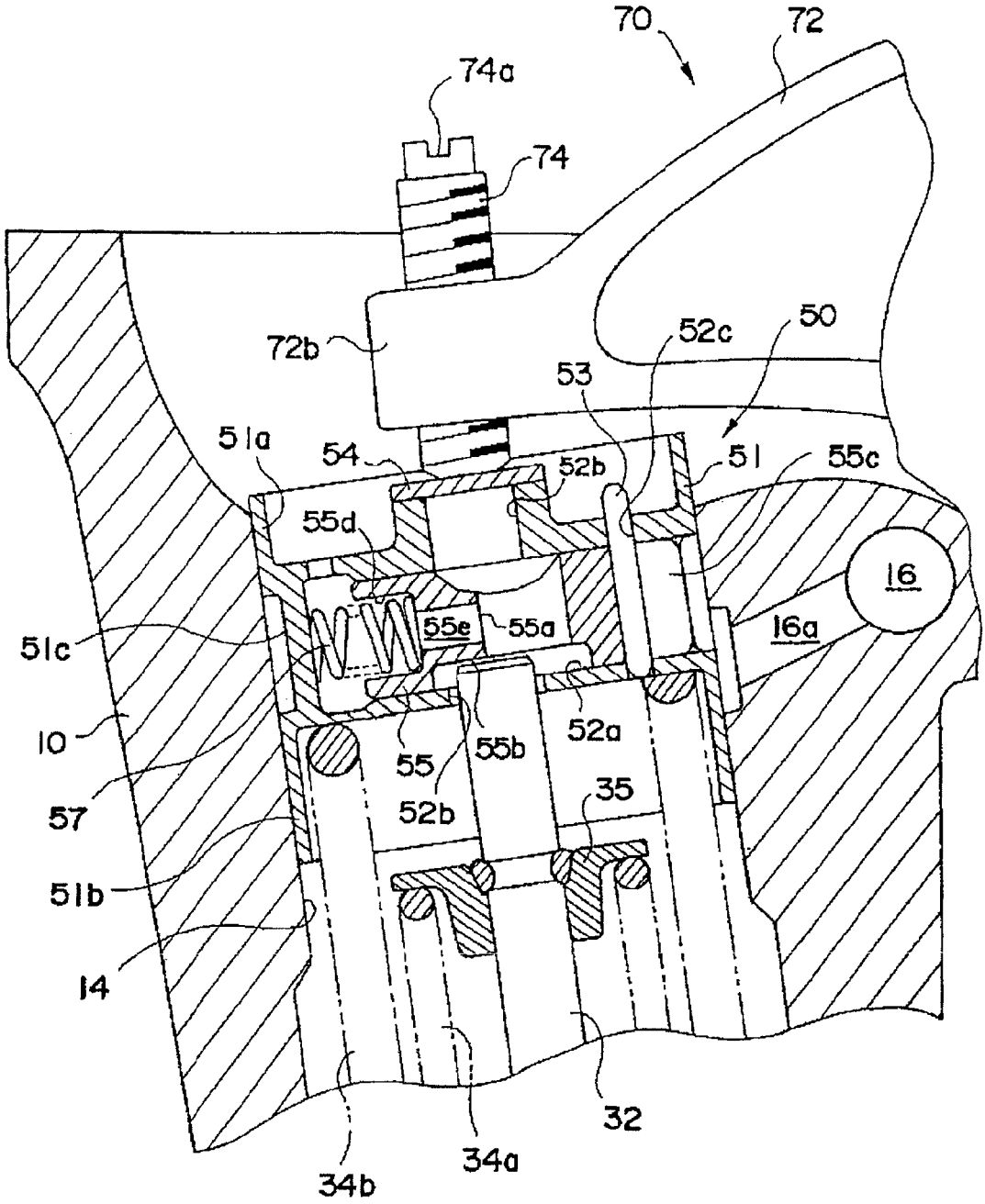
FIG. 2 is a cross section showing the structure of a peripheral portion of an exhaust valve stopping mechanism in the engine.
Figure 3:
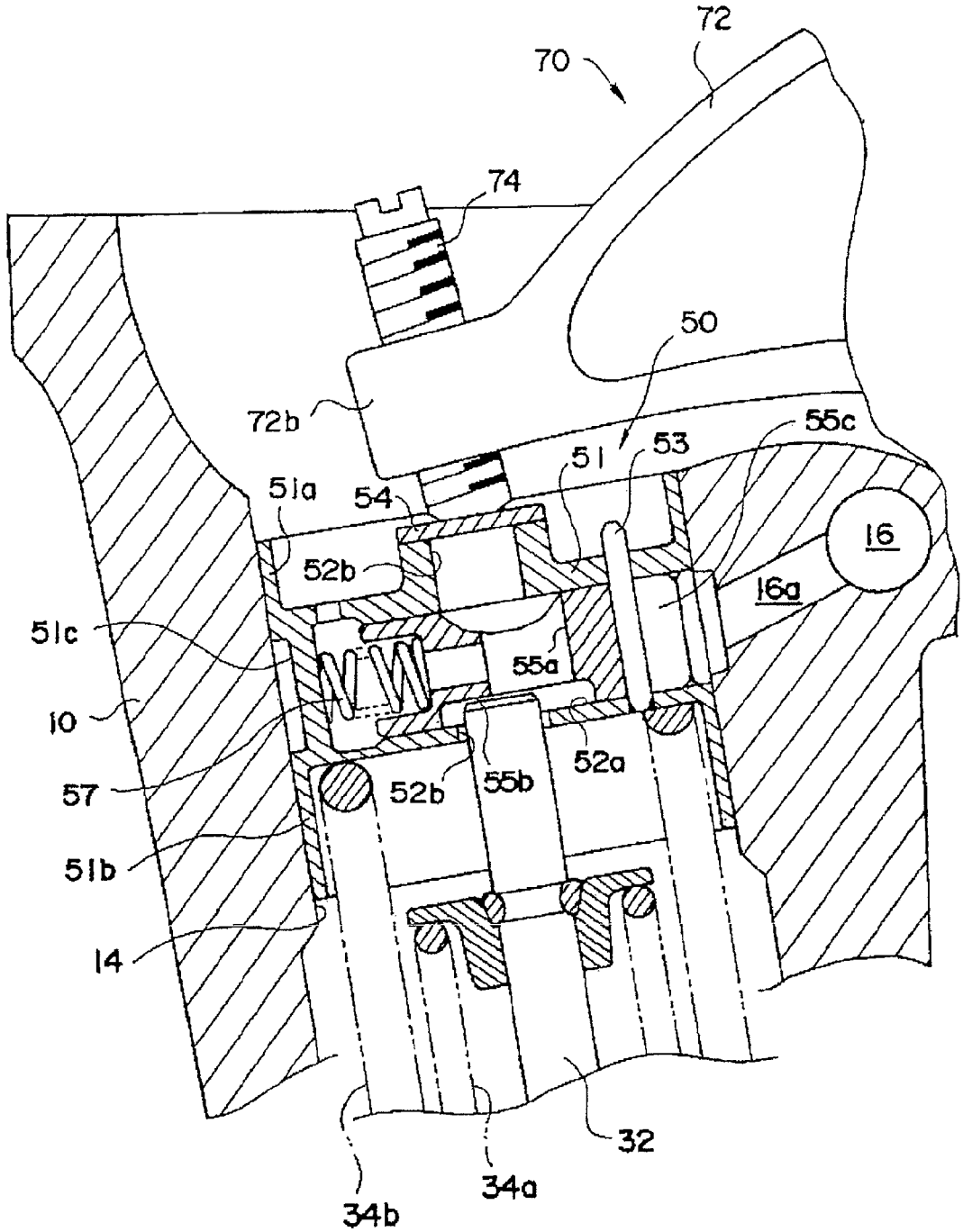
FIG. 3 is a cross section showing the structure of a peripheral portion of the exhaust valve stopping mechanism in the engine.

In the cylinder head 10, an exhaust valve hydraulic fluid supply path 16 is formed, which supplies exhaust valve stop hydraulic fluid supplied from a stop hydraulic fluid pressure supplying device 80 which will be described later into the hydraulic fluid receiving groove 51*c* in the plunger holder 51. A front-end fluid passage 16*a* of the exhaust valve hydraulic fluid supply path 16 is open to the inside of the guide hole 14 and is communicated with the hydraulic fluid receiving groove 51*c* in this portion. The plunger holder 51 is pressed by the rocker arm mechanism 70 and slides vertically in the guide hole 14. When the plunger holder 51 moves upward as shown in FIG. 2, and also when the plunger holder 51 moves downward as shown in FIG. 3, the hydraulic fluid receiving groove 51*c* at least partially communicates with the front-end fluid passage path 16*a*. The exhaust valve stop hydraulic fluid supplied via the exhaust valve hydraulic fluid supply path 16 is supplied into the hydraulic fluid receiving groove 51*c*. In such a manner, the stop hydraulic fluid supplied into the hydraulic fluid receiving groove 51*c* acts on the right end of the stop selecting plunger 55 to press the stop selecting plunger 55 to the left side.

Next, a stop hydraulic fluid pressure supplying device 80 for the exhaust valve performs control so as to supply an exhaust valve stop hydraulic fluid pressure to the exhaust valve hydraulic fluid supply path 16. The stop hydraulic fluid pressure supplying device 80 will be described with reference to FIGS. 7 and 8. The stop hydraulic fluid pressure supplying device 80 has a valve body 81, a spool valve 85 disposed slidably in a spool hole 81*a* formed in the valve body 81, a plug 87 closing the spool hole 81*a* in which the spool valve 85 is disposed at the left end, a spool spring 86 for energizing the spool valve 85 to the right direction, and a solenoid mechanism 90 attached at the right end of the valve body 81.

In the stop hydraulic fluid pressure supplying device 80, an inlet port 82*a* connected to a stop hydraulic pressure supply source P for supplying the stop hydraulic fluid whose pressure is adjusted to not-shown predetermined hydraulic pressure, an outlet port 82*b* is connected to the exhaust valve hydraulic fluid supply path 16, and a drain port 82*c* is connected to the drain side are connected to a spool hole 81*a* as shown in the diagram. By performing a control of laterally sliding the spool valve 85 in the spool hole 81*a*, a hydraulic fluid supply stop state (state shown in FIG. 7) and a hydraulic fluid supply state (state shown in FIG. 8) are generated. In the hydraulic fluid supply stop state, communication via the spool hole 81*a* between the inlet port 82*a* and the outlet port 82*b* is interrupted, and the outlet port 82*b* and the drain port 82*c* are communicated with each other via the spool hole 81*a*. In the hydraulic fluid supply state, the inlet port 82*a* and the outlet port 82*b* are communicated with each other via the spool hole 81*a*, and the communication via the spool hole 81*a* between the outlet port 82*b* and the drain port 82*c* is interrupted.

In the valve body 81, a first bypass 83*a* and a second bypass 83*b* are formed. The first bypass 83*a* is communicated with the inlet port 82*a* and the outlet port 82*b* via small holes 82*d* and 82*e* and is provided with, at its end, an open/close port member 84 having an open/close hole 84*a* which is opened/closed by a poppet 91 of the solenoid mechanism 90. The second bypass 83*b* makes the right-side space of the open/close port member 84 and the right end of the spool hole 81*a* communicate with each other.

The solenoid mechanism 90 has a solenoid 92 energized by power supplied via a cable (not shown) connected to a connector 93, the poppet 91 pulled to the right by reception of the excitation force of the solenoid 92, and a poppet spring 94 for energizing the poppet 91 to the left. At the left end of the poppet 91, an open/close projection 91*a* which projects into the open/close hole 84*a* from the right side and closes the open/close hole 84*a* is formed on the left end of the poppet 91. In a non-energizing state of the solenoid 92, the poppet 91 is moved to the left by being energized by the poppet spring 94, and the open/close projection 91*a* enters the open/close hole 84*a* to close the open/close hole 84*a*. On the other hand, when the solenoid 92 is energized, the poppet 91 is moved to the right against the force of the poppet spring 94, and the open/close projection 91*a* is apart from the open/close hole 84*a*.

Figure 7:
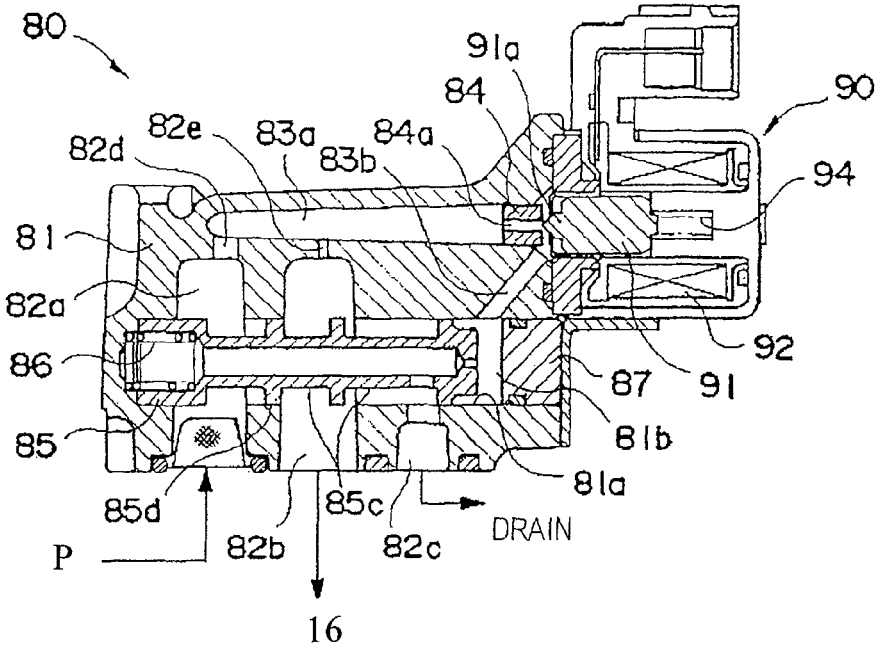
FIG. 7 is a cross section showing the configuration of a stop hydraulic fluid pressure supplying device.

FIG. 7 shows an energization state of the solenoid 92. In the energized state, a force of pulling the poppet 91 by the solenoid 92 acts. The poppet 91 is moved to the right against the force of the poppet spring 94, and the open/close projection 91 a of the poppet 91 is apart from the open/close hole 84*a* in the open/close port member 84 to open the open/close hole 84*a*. Consequently, the hydraulic fluid supplied from the stop hydraulic fluid supply source P to the inlet port 82*a* passes from the small hole 82*d* through the first bypass 83*a* and the open/close hole 84*a* and is supplied to the second bypass 83*b*. Further, the hydraulic fluid flows into a spool fluid chamber 81*b* surrounded by a plug 87 and the right end face of the spool valve 85 in the spool hole 81*a*.

As a result, the stop hydraulic fluid pressure of the hydraulic fluid in the spool fluid chamber 81*b* moves the spool valve 85 to the left against the force of the spool spring 86 and is positioned in the position in FIG. 7. By a spool groove 85*c* and a land 85*d* formed as shown in the diagram in the spool valve 85, communication between the inlet port 82*a* and the outlet port 82*b* via the spool hole 81*a* is interrupted, the outlet port 82*b* and the drain port 82*c* are communicated with each other via the spool hole 81*a*, and the hydraulic fluid in the hydraulic fluid supply path 16 is exhausted to the drain side. In such a manner, the hydraulic fluid supply stop state is generated in which the hydraulic pressure for moving the stop selecting plunger 55 against the force to the stop selecting plunger 55 of the plunger spring 57 is not applied to the stop selecting plunger 55. The hydraulic fluid supplied from the inlet port 82*a* into the first bypass 83*a* flows in the outlet port 82*b* via the small hole 82*e*. However, the inflow amount is small and all of the hydraulic fluid is exhausted to the drain side. Thus, the fluid pressure in the hydraulic fluid supply path 16 decreases.

Since the spool valve 85 is forcedly moved to the left by using the stop hydraulic fluid pressure of the hydraulic fluid supplied into the spool fluid chamber 81*b*, by properly setting the degree of the stop hydraulic fluid pressure, the spool valve 85 can be moved to the left at an arbitrary speed. In the embodiment, by rapidly moving the spool valve 85 to the left and promptly discharging the hydraulic fluid in the hydraulic fluid supply path 16 connected to the outlet port 82*b* to the drain side, the fluid pressure acting on the stop selecting plunger 55 is rapidly decreased. It quickens the movement of the stop selecting plunger 55 by the force of the plunger spring 57 at the time of shift from the stop state of the exhaust valve 30 to the operation state, and the response is increased.

Figure 8:
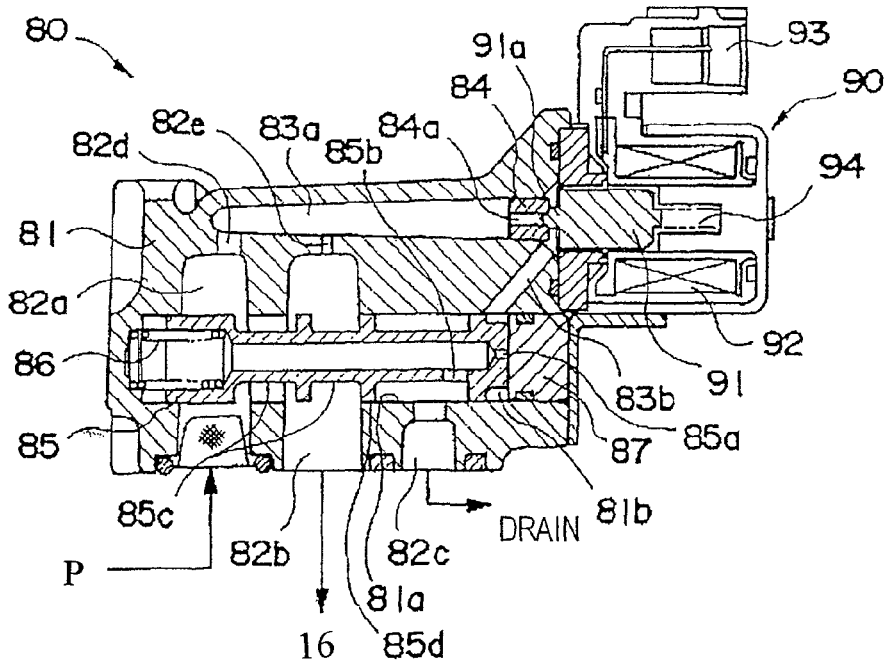
FIG. 8 is a cross section showing the configuration of the stop hydraulic fluid pressure supplying device.

On the other hand, the non-energization state of the solenoid 92 is shown in FIG. 8. Since the force of pulling the poppet 91 to the right by the solenoid 92 does not act, the poppet 91 is moved to the left by the force of the poppet spring 94, and the open/close projection 91*a* of the poppet 91 enters the open/close hole 84*a* in the open/close port member 84 to close the open/close hole 84*a*. Consequently, the hydraulic fluid supplied from the stop fluid pressure supply source P to the inlet port 82*a* and supplied to the first bypass 83*a* does not flow in the second bypass 83*b*. The hydraulic fluid in the spool fluid chamber 81*b* is drained via the small holes 85*a* and 85*b* formed in the spool valve 85.

As a result, the spool valve 85 is moved to the right by the force of the spool spring 86 to the position of FIG. 8. By the spool groove 85*c* and the land 85*d* formed as shown in the diagram in the spool valve 85, the inlet port 82*a* and the outlet port 82*b* are communicated with each other via the spool hole 81*a*, and the communication between the outlet port 82*b* and the drain port 82*c* is interrupted. Consequently, the hydraulic fluid supplied to the inlet port 82*a* is supplied to the exhaust valve hydraulic fluid 16, the stop selecting plunger 55 is moved against the force of the plunger spring 57, and the hydraulic fluid supply state is generated.

Next, the intake valve stopping mechanism 40 will be described with reference to FIGS. 9 and 10. The operation principle of the mechanism 40 is similar to that of the exhaust valve stopping mechanism 50.

The intake valve stopping mechanism 40 has a bottomed cylindrical valve lifter 48 slidably fit in the guide hole 13. A plunger holder 41 is fit in an insertion hole 48*a* formed in the valve lifter 48. The plunger holder 41 has a configuration almost the same as that of the plunger holder 51 of the exhaust valve stopping mechanism 50. In the plunger holder 41, a plunger hole 42*a* extending in the direction orthogonal to the sliding direction of the valve lifter 48 is formed so as to penetrate. A stop selecting plunger 45 is slidably fit in the plunger hole 42*a* and is energized to one side in the sliding direction (to the left in the diagram) by a plunger spring 47. In the plunger holder 41, a holder-side stem receiving hole 42*b* passing the center of the outer cylindrical shape and penetrating in the vertical direction is formed, and the upper end abuts on the bottom face of the valve lifter 48. The holder-side stem receiving hole 42*b* is set larger than the diameter of the tip of the valve stem 22 of the intake valve 20. As will be described later, the size of the tip of the valve stem 22 is set so that it can project to the inside of the holder-side stem receiving hole 42*b* and be received.

In the stop selecting plunger 45, a slit 45*c* extending in the radial direction is formed on one end side in the axial direction (the left end side in the diagram). On the other end side (the right end side in the diagram), a plunger-side stem receiving hole 45*a*, receiving the plunger spring 47 and extending orthogonally and passing the center of the axis, is formed in the center portion in the axial direction. The size of the plunger-side stem receiving hole 45*a* is set larger than the diameter of the end of the valve stem 22 of the intake valve 20 so that, as will be described later, the tip of the valve stem 22 can project into the plunger-side stem receiving hole 45*a*. The lower end opening of the plunger-side stem receiving hole 45*a* is cut in a plane, thereby forming a step abutment face 45*b*.

In the plunger holder 41, further, a pin hole 42*c* positioned near the open end of the plunger hole 42*a*, crossing the center of the plunger hole 42*a*, and penetrating in the vertical direction is formed. A stopper pin 43 is fit in the pin hole 42*c*. The stopper pin 43 is fit in the slit 45*c* in the stop selecting plunger 45 fit in the plunger hole 42*a*. The stop selecting plunger 45 is pressed to the left side in the diagram by the plunger spring 47, and the bottom of the slit 45*c* abuts on the stopper pin 43 and is held in the position shown in FIG. 10. In the position, rotation of the stop selecting plunger 45 is regulated by the stopper pin 43, the stem abutment face 45*b* is positioned on the under face side, and the plunger-side stem receiving hole 45*a* is positioned deviated from the holder-side stem receiving hole 42*b* in the axial direction. The upper end of the valve stem 22 of the intake valve 20 closely faces the step abutment face 45*b*. The position of the stop selecting plunger 45 at this time will be called an operating position.

On the other hand, a ring-shaped hydraulic fluid receiving groove 41*c* is formed in an intermediate portion on the cylindrical peripheral face of the plunger holder 41. In the state where the plunger holder 41 is fit in the insertion hole 48*a* in the valve lifter 48, the hydraulic fluid receiving groove 41*c* faces a communication hole 48*b* formed in the outer periphery of the valve lifter 48. In the cylinder head 10, an intake valve hydraulic fluid supply path 17 for supplying passage hydraulic fluid supplied from the stop hydraulic fluid pressure supplying device 80 is formed. A front-end fluid passage 17*a* of the intake valve hydraulic fluid supply path 17 is connected to a hydraulic fluid receiving groove 17*b* formed in a ring shape in the guide hole 13 and, in this part, communicated with the communication hole 48*b* in the valve lifter 48.

A top face 48*c* of the valve lifter 48 is pressed by the intake valve drive cam 8 provided for the camshaft 6 and vertically slides and moves in the guide hole 13*e* together with the plunger holder 41. During the vertical movement, the communication hole 48*b* is at least partly communicated with the hydraulic fluid receiving groove 17*b*. The intake valve stop hydraulic fluid supplied via the hydraulic fluid supply path 17 is supplied from the communication hole 48*b* into the hydraulic fluid receiving groove 41*c*. The intake valve stop hydraulic fluid supplied into the hydraulic fluid receiving groove 41*c* enters the plunger holder 42*a*, and the hydraulic fluid acts on the left end of the stop selecting plunger 45 to press it to the right direction.

The operation of the valve when the engine E constructed as described above operates will be described hereinbelow. First, the operation in a state where the intake valve stop hydraulic fluid is not supplied to the exhaust valve hydraulic fluid supply path 16 and the intake valve hydraulic fluid supply path 17 will be described. As described above, when the hydraulic fluid is not supplied to the exhaust valve hydraulic fluid supply path 16, in the exhaust valve stopping mechanism 50, a press force overcoming the force of the plunger spring 57 based on the hydraulic fluid pressure is not generated at the end on the side where the slit 55*c* in the stop selecting plunger 55 fit in the plunger hole 52*a* is provided. As shown in FIGS. 2 and 3, the stop selecting plunger 55 is moved to the right by the force of the plunger spring 57 and is positioned in the operating position. In the state where the stop selecting plunger 55 is in the operating position as described above, the plunger-side stem receiving hole 55*a* formed in the stop selecting plunger 55 is positioned deviated from the holder-side stem receiving hole 52*b*, and the tip of the valve stem 32 of the exhaust valve 30 enters the holder-side stem receiving hole 52*b*, and closely faces the stem abutment face 55*b* of the stop selecting plunger 55.

When the engine E is operated in this state, the camshaft 6 is rotated in correspondence with the rotation of the crankshaft, and the rocker arm 72 is made swing by the exhaust valve drive cam 7 provided for the camshaft 6. More specifically, in a state where the cylindrical cam face 7*a* of the exhaust valve drive cam 7 abuts on the cam follower 73, the rocker arm 72 is in the position shown in FIGS. 1 and 2. In a state where the projection cam face 7*b* abuts on the cam follower 73, the cam follower 73 is pushed upward and the rocker arm 72 swings counterclockwise to the position shown in FIG. 3. That is, in the state shown in FIGS. 1 and 2, the press member 74 attached to the left end 72*b* of the rocker arm 72 is in an upward movement position. In the state shown in FIG. 3, the press member 74 is in a downward movement position.

At this time, the exhaust valve stopping mechanism 50 is pushed upward by the second exhaust valve spring 34*b* and the abutment plate 54 abuts on the lower end face of the press member 74. Consequently, the exhaust valve stopping mechanism 50 vertically slides in the guide hole 14 together with the vertical movement of the press member 74. On the other hand, when the press member 74 is in the upward movement position shown in FIGS. 1 and 2, the tip of the valve stem 32 of the exhaust valve 30 enters the holder-side stem receiving hole 52*b* and closely faces the stem abutment face 55*b* of the stop selecting plunger 55. In this state, the exhaust valve 30 lifted by the first exhaust valve spring 34*a* closes the exhaust port 12*a* by the valve body 31. In other words, the attachment position to the rocker arm 72 of the press member 74 is adjusted so that the valve body 31 closes the exhaust port 12*a* and the upper end of the valve stem 32 closely faces the stem abutment face 55*b*.

When the press member 74 is moved downward from the upper movement position shown in FIG. 2, together with the press member 74, the exhaust valve stopping member 50 slides downward in the guide hole 14 as shown in FIG. 3. Concurrently, the upper end of the valve stem 32 abuts on the stem abutment face 55*b* to press the exhaust valve 30 downward, and the valve body 31 is apart from the exhaust port 12*a* to open the exhaust port 12*a*. After that, the engine E is operated, the camshaft 6 is rotated, and the rocker arm 72 is made swing by the exhaust valve drive cam 7. According to the swing, the exhaust valve 30 is opened/closed.

When the exhaust valve 30 is opened/closed as described above, the stem abutment face 55*b* receives the press force from the valve stem 32 (press force reaction of the exhaust valve drive cam 7). The part for receiving the exhaust valve stop hydraulic fluid pressure (the right end in the diagram of the stop selecting plunger 55) is apart from the stem abutment face 55*b* while sandwiching the plunger-side stem receiving hole 55*a*. Consequently, the influence of the press force (for example, elastic deformation) acting on the stem abutment face 55*b* on the part for receiving the stop hydraulic fluid pressure is suppressed. Deformation of the right end of the stop selecting plunger 55 is very small, so that sealing performance of the portion is excellently maintained, and durability improves. This point is similarly applied to the stop selecting plunger 45 of the intake valve stopping mechanism 40.

Further, by forming a communication hole 55e connecting the stem receiving hole 55*a* and the spring receiving recess 55*d* in an overlap portion in the sliding direction with the stem abutment face 55*b* in the stop selecting plunger 55, the weight of the stop selecting plunger 55 is reduced. It improves sliding response of the stop selecting plunger 55. Further, the weight of the whole exhaust valve stopping mechanism 50 is reduced, and operation response of the exhaust valve 30 also improves. This point is also similarly applied to the intake valve stopping mechanism 40 and the stop selecting plunger 45.

The intake valve stopping mechanism 40 also performs similar operations. More specifically, since the fluid pressure does not act on the left end of the stop selecting plunger 45, the stop selecting plunger 45 is moved to the left by the force of the plunger spring 47 and positioned in the operating position shown in FIG. 10. In this state, the plunger-side stem receiving hole 45*a* formed in the stop selecting plunger 45 is positioned to be deviated from the holder-side stem receiving hole 42*b*, the tip of the valve stem 22 of the intake valve 20 enters the holder-side stem receiving hole 42*b*, and closely faces the stem abutment face 45*b* of the stop selecting plunger 45.

When the engine E is operated in this state and the camshaft 6 is rotated in correspondence with rotation of the crankshaft, the intake valve stopping mechanism 40 is lifted by the second intake valve spring 24*b* and the top face 48*c* of the valve lifter 48 abuts on the intake valve drive cam 8, so that the valve lifter 48 is pressed downward by the intake valve drive cam 8, and the intake valve mechanism 40 is moved in the vertical direction. That is, when the cylindrical cam face 8*a* of the intake valve drive cam 8 abuts on the top face 48*c* of the valve lifter 48, the intake valve stopping mechanism 40 is moved upward. When the projected cam face 8*b* abuts on the top face 48*b*, the intake valve stopping mechanism 40 is moved downward.

Figure 9:
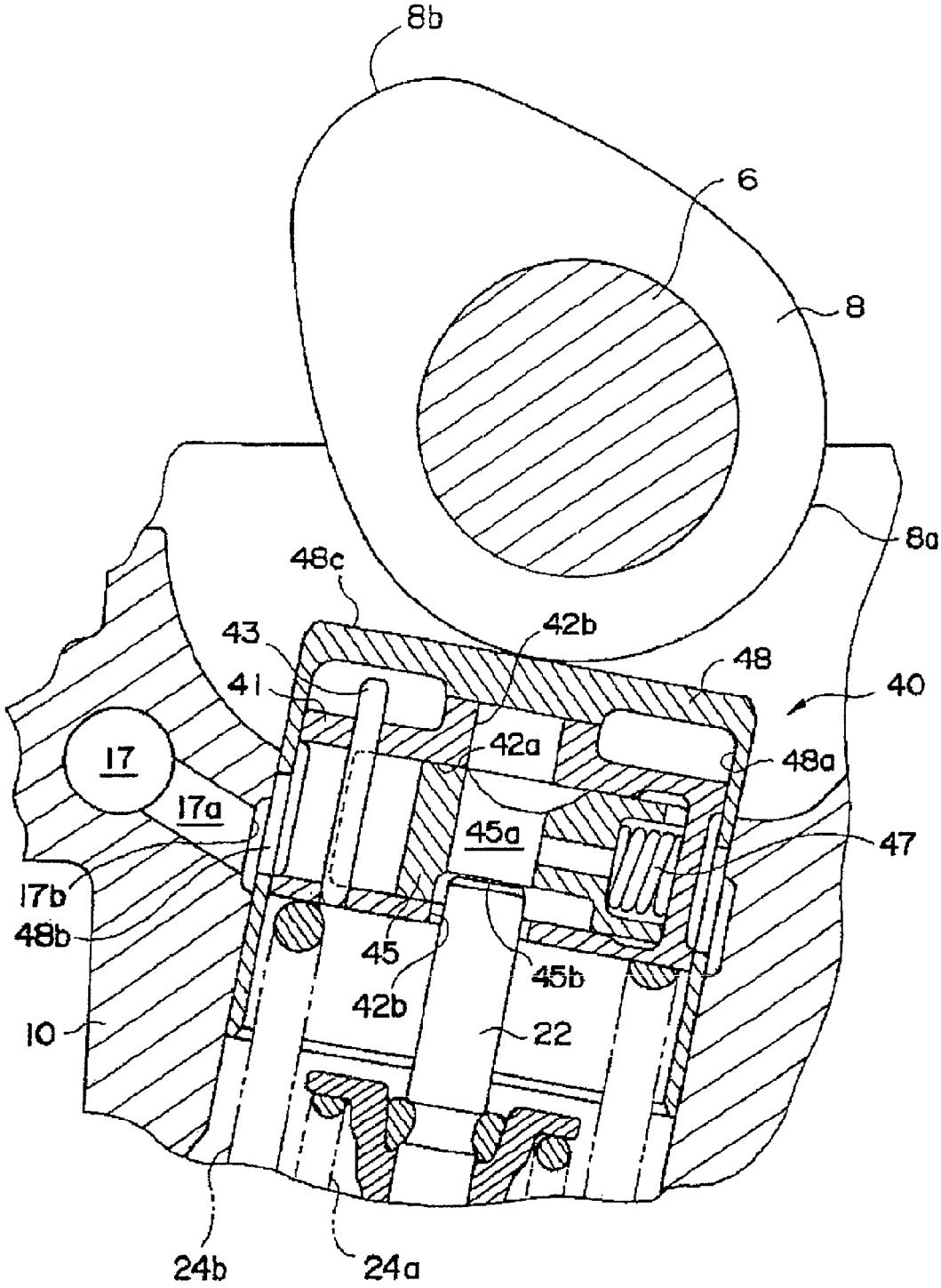
FIG. 9 is a cross section showing the structure of a peripheral portion of an intake valve stopping mechanism in the engine.
Figure 10:
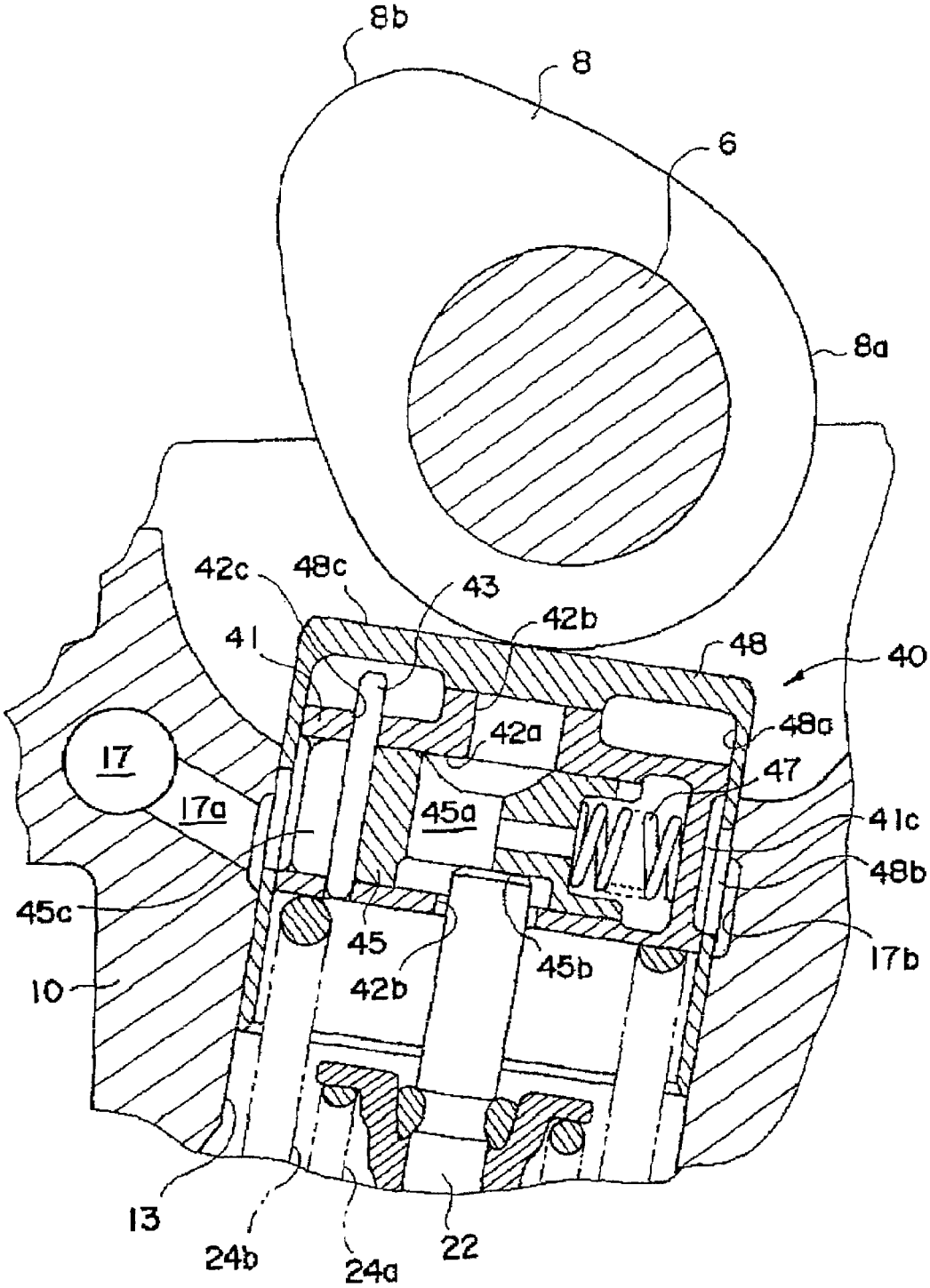
FIG. 10 is a cross section showing the structure of a peripheral portion of the intake valve stopping mechanism in the engine.

On the other hand, when the intake valve stopping mechanism 40 is in the upper movement position shown in FIG. 9, the tip of the valve stem 22 of the intake valve 20 lifted by the first intake valve spring 24*a* enters the holder-side stem receiving hole 42*b* and closely faces the stem abutment face 45*b* of the stop selecting plunger 45. In this state, the valve body 21 of the intake valve 20 closes the intake port 11*a*.

When the intake valve stopping mechanism 40 is moved downward from the upper movement position shown in FIG. 9 according to the rotation of the intake valve drive cam 8, the upper end of the valve stem 22 abuts on the stem abutment face 45*b*, the intake valve 20 is pressed downward, and the valve body 21 is apart from the intake port 11*a* and opens the intake port 11*a*. After that, the engine E is operated to rotate the camshaft 6. By the intake valve drive cam 8, the intake valve stopping mechanism 40 is moved in the vertical direction. According to the vertical movement, the intake valve 20 is opened/closed.

As described above, in a state where the intake valve stopping hydraulic fluid is not supplied to the exhaust valve hydraulic fluid supply path 16 and the intake valve hydraulic fluid supply path 17, the engine E is operated. In correspondence with rotation of the crankshaft, the cam shaft 6 is rotated. By the exhaust valve drive cam 7 provided for the cam shaft 6, the rocker arm 72 is allowed to swing to open/close the exhaust valve 30. By the intake valve drive cam 8, the intake valve 20 is opened/closed. In the cylinder, normal operation is performed.

Next, the case where the exhaust valve hydraulic fluid is supplied from the stop hydraulic fluid pressure supplying device 80 to the exhaust valve hydraulic fluid supply path 16 and the intake valve stop hydraulic fluid is supplied from the stop hydraulic fluid pressure supplying device 80 to the intake valve hydraulic fluid supply path 17 will be described. A control is performed to simultaneously stop the intake valve 20 and the exhaust valve 30 by supplying the stop hydraulic fluid simultaneously from the stop hydraulic fluid pressure supplying device 80 to the exhaust valve hydraulic fluid supply path 16 and the intake valve hydraulic fluid supply path 17.

Figure 5:
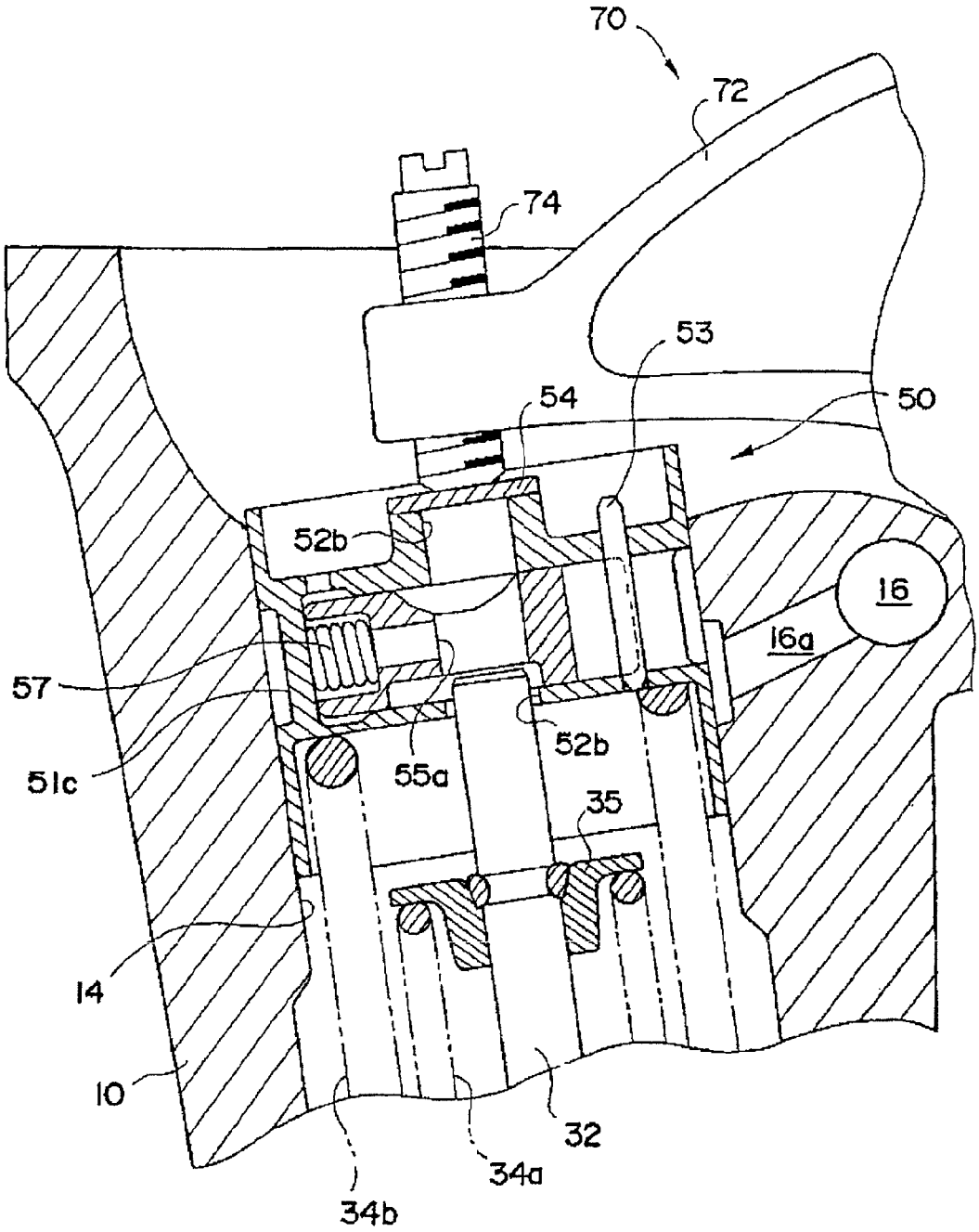
FIG. 5 is a cross section showing the structure of a peripheral portion of the exhaust valve stopping mechanism in the engine.
Figure 6:
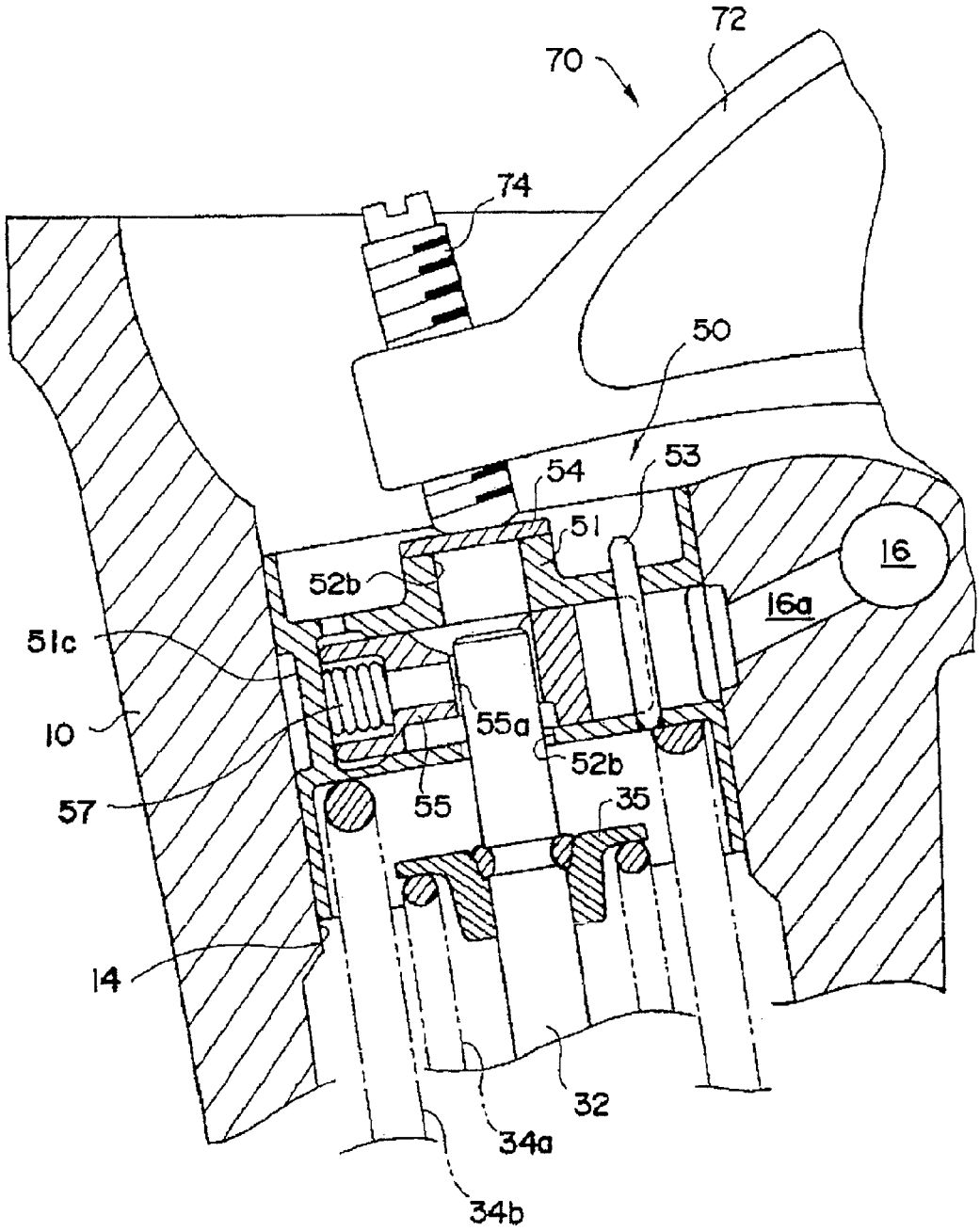
FIG. 6 is a cross section showing the structure of a peripheral portion of the exhaust valve stopping mechanism in the engine.

Amen the exhaust valve stop hydraulic fluid is supplied to the exhaust valve hydraulic fluid supply path 16, in the exhaust valve stopping mechanism 50, the stop selecting plunger 55 fit in the plunger hole 52*a* receives the press force generated by the hydraulic fluid pressure, is moved to the left against the force of the plunger spring 57 and is positioned in the stop position, as shown in FIGS. 5 and 6. In a state where the stop selecting plunger 55 is in the stop position, the plunger-side stem receiving hole 55*a* formed in the stop selecting plunger 55 matches the holder-side stem receiving hole 52*b* in the vertical direction. The tip of the valve stem 32 of the exhaust valve 30 enters the holder-side stem receiving hole 52*b* and can also enter the plunger-side stem receiving hole 55*a*.

When the engine E is operated in this state, the camshaft 6 is rotated in correspondence with rotation of the crankshaft, and the rocker arm 72 is swung by the exhaust valve drive cam 7, as described above, the exhaust valve stopping mechanism 50 is pressed by the press member 74 and slides vertically in the guide hole 14. However, when the exhaust valve stopping mechanism 50 is moved in the vertical direction and moved from the position shown in FIG. 5 downward as shown in FIG. 6, the tip of the valve stem 32 of the exhaust valve 30 enters the holder-side stem receiving hole 52*b* and also the plunger-side stem receiving hole 55*a*. Consequently, the exhaust valve 30 is held while being lifted by the first exhaust valve spring 34*a*.

As a result, even when the camshaft 6 is rotated, the rocker arm 72 is swung by the exhaust valve drive cam 7, and the exhaust valve stopping mechanism 50 slides vertically in the guide hole 14, the exhaust valve 30 is held while closing the exhaust port 12*a* with the valve body 31. That is, the exhaust valve 30 is stopped in a closed state.

The intake valve stopping mechanism 40 also performs similar operations. More specifically, when the stop hydraulic fluid pressure acts on the left end of the stop selecting plunger 45, the stop selecting plunger 45 receives the hydraulic pressure, is moved to the right against the force of the plunger spring 47, and is positioned in the stop position shown in FIG. 10. In this state, the plunger-side stem receiving hole 45*a* formed in the stop selecting plunger 45 matches the holder-side stem receiving hole 42*b*. The tip of the valve stem 22 of the intake valve 20 enters the holder-side stem receiving hole 42*b* and can also enter the plunger-side stem receiving hole 45*a* in the stop selecting plunger 45.

When the engine E is operated in this state and the camshaft 6 is rotated in correspondence with rotation of the crankshaft, the valve lifter 48 is pressed downward by the intake valve drive cam 8. Even when the intake valve mechanism 40 is moved vertically, the tip of the valve stem 22 of the intake valve 20 enters the holder-side stem receiving hole 42*b* and also the plunger-side stem receiving hole 45*a*. Consequently, the intake valve 20 is held while being lifted by the first intake valve spring 24*a*. As a result, even when the camshaft 6 is rotated and the intake valve stopping mechanism 40 is moved so as to slide in the vertical direction in the guide hole 13 by the intake valve drive cam 8, the intake valve 20 is held while closing the intake port 11*a* with the valve body 21. That is, the intake valve 20 is held stopped in the closed state.

As understood from the above description, in the engine E described in the embodiment, at the time of operating the engine in a state where the stop hydraulic fluid is not supplied from the stop hydraulic fluid pressure supplying device 80 and the like to the exhaust valve hydraulic fluid supply path 16 and the intake valve hydraulic fluid supply path 17 (or in a state where the internal fluid pressure is low), when the camshaft 6 is rotated according to rotation of the crankshaft, normal operations of opening/closing the intake and exhaust valves 20 and 30 are performed. On the other hand, when the stop hydraulic fluid pressure is supplied from the stop hydraulic fluid pressure supplying device 80 or the like to the exhaust valve hydraulic fluid supply path 16 and the intake valve hydraulic fluid supply path 17, regardless of the rotational drive of the camshaft, the intake and exhaust valves 20 and 30 are always held closed, and the cylinder having the intake and exhaust valves is in a stop state.

Consequently, when the stop hydraulic fluid pressure is low at the start of the engine or the like, the normal operations of opening/closing the intake and exhaust valves 20 and 30 are performed. Also in a very-low-speed operating state at start of the engine or the like, a predetermined large output can be obtained. Thus, an engine having an excellent starting performance is obtained.

At the time of switching a cylinder stop state where the stop hydraulic fluid is supplied from the stop hydraulic fluid supplying device 80 or the like to the exhaust valve hydraulic fluid supply path 16 and the intake valve hydraulic fluid supply path 17 and the intake and exhaust valves 20 and 30 are always held closed to a cylinder operation state where the intake and exhaust valves 20 and 30 are operated by making the exhaust valve hydraulic fluid supply path 16 and the intake valve hydraulic fluid supply path 17 communicate with the drain side in the stop hydraulic fluid pressure supplying device 80 to decrease the hydraulic fluid pressure, as described above, the solenoid 92 is energized in the stop hydraulic fluid pressure supplying device 80 to move the poppet 91 to the right, the fluid pressure is applied to the right end face of the spool valve 85, the spool valve 85 is rapidly moved to the left, and the hydraulic fluid in the valve hydraulic fluid supply path 16 and the intake valve hydraulic fluid supply path 17 is forcedly and promptly discharged to the drain side. Consequently, response of a switch from the cylinder stop state to the cylinder operation state is high. When the driver performs an operation of opening the throttle in the cylinder stop operation state, the state is promptly shifted to the cylinder operation state by movement of the stop selecting plunger 55 by the energizing force of the plunger spring 57. Thus, response to a request for increasing an output of the engine improves.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a valve provided for a cylinder head of the engine;

a valve energizing member for energizing the valve in the direction of closing the valve;

a valve drive cam rotated in correspondence with rotation of a crankshaft of the engine;

a valve stopping mechanism operatively provided between the valve drive cam and the valve and, on the basis of a stop hydraulic fluid pressure supplied from outside and an operation energizing member for generating an energizing force against the stop hydraulic fluid pressure, selectively generating an operating state of opening/closing the valve in response to an operation of the valve drive cam and a stop state of holding the valve in a valve closing position irrespective of the operation of the valve drive cam; and a stop hydraulic fluid pressure supply controller for controlling the supply of the stop hydraulic fluid pressure;

wherein the valve stopping mechanism generates the operating state when the energizing force of the operation energizing member is larger than the press force of the stop hydraulic fluid pressure, and generates the stop state when the press force of the stop hydraulic fluid pressure is larger than the energizing force of the operation energizing member; and the stop hydraulic fluid pressure supply controller includes:

a valve body;

a switching member movable within the valve body between a hydraulic fluid supply position in which a pressure source path is connected to a pressure source for supplying the stop hydraulic fluid pressure and a stop pressure supply path for supplying the stop hydraulic fluid pressure to the valve stopping mechanism are communicated with each other, and a hydraulic fluid discharging position for closing the pressure source path and making the stop pressure supply path communicated with a drain side;

a switching energizing member applying a force at one end of the switching member for energizing the switching member to move to a hydraulic fluid supply position side; and a switching pressure supply control mechanism for applying a pressure force at an opposite end of the switching member to move the switching member to a hydraulic fluid discharge position side, the switching pressure supply control mechanism being attached to the valve body in a position offset relative to an axis of the switching member.

2. The engine according to claim 1, wherein the switching pressure supply control mechanism is constructed by a solenoid valve and, when a solenoid is energized, applies the pressure force to move the switching member to the hydraulic fluid discharge position side.

3. The engine according to claim 1, wherein the valve stopping mechanism includes:

a holder reciprocated in the direction of opening/closing the valve by the valve drive cam; and a stop selecting member disposed in the holder and capable of moving in a direction which is perpendicular to a length of the valve between an operating position to open/close the valve in accordance with a reciprocating operation of the holder and a stop position to hold the valve in the valve closing position irrespective of the reciprocating operation of the holder;

wherein the stop selecting member is a plunger capable of moving in one direction from the operating position and in an opposite direction stop position;

the operation energizing member on one end of the plunger energizes the plunger to the operation position side; and the plunger which receives the stop hydraulic fluid pressure is pressed to the stop position against the energizing force of the energizing member.

4. The engine according to claim 2, wherein the valve stopping mechanism includes:

a holder reciprocated in the direction of opening/closing the valve by the valve drive cam; and a stop selecting member disposed in the holder and capable of moving in a direction which is perpendicular to a length of the valve between an operating position to open/close the valve in accordance with a reciprocating operation of the holder and a stop position to hold the valve in the valve closing position irrespective of the reciprocating operation of the holder;

wherein the stop selecting member is a plunger capable of moving in one direction from the operating position and in an opposite direction stop position;

the operation energizing member on one end of the plunger energizes the plunger to the operation position side; and the plunger which receives the stop hydraulic fluid pressure is pressed to the stop position against the energizing force of the energizing member.

5. The engine according to claim 3, wherein the valve comprises a valve body for opening/closing the communication part and a valve stem connected to the valve body and extending toward the valve stopping mechanism;

the tip of the valve stem passes through the holder and faces the stop selecting member;

in the plunger, a stem abutment face and a stem receiving part are formed;

when the plunger is in the operating position, the stem abutment face abuts on the tip of the valve stem and moves the valve in the open/close direction together with the holder;

when the plunger is in the stop position, the tip of the valve stem is fit in the stem receiving part, and the stem receiving part moves the holder but maintains the valve closed;

the stem abutment face and the stem receiving part are formed adjacent to each other in the direction of moving the plunger, and the stop hydraulic fluid pressure is received on the side opposite to the stem abutment face in the direction of moving the plunger while sandwiching the stem receiving part.

6. The engine according to claim 4, wherein the valve comprises a valve body for opening/closing the communication part and a valve stem connected to the valve body and extending toward the valve stopping mechanism;

the tip of the valve stem passes through the holder and faces the stop selecting member;

in the plunger, a stem abutment face and a stem receiving part are formed;

when the plunger is in the operating position, the stem abutment face abuts on the tip of the valve stem and moves the valve in the open/close direction together with the holder;

when the plunger is in the stop position, the tip of the valve stem is fit in the stem receiving part, and the stem receiving part moves the holder but maintains the valve closed;

the stem abutment face and the stem receiving part are formed adjacent to each other in the direction of moving the plunger, and the stop hydraulic fluid pressure is received on the side opposite to the stem abutment face in the direction of moving the plunger while sandwiching the stem receiving part.

7. The engine according to claim 5, wherein an energizing member housing part for housing the operation energizing member is formed on the same side of the plunger as the side on which the stem abutment face is formed in a movement direction of the plunger; and a stem communication hole via which the energizing member housing part and the stem housing part communicate with each other is provided in a position overlapping the stem abutment face in the movement direction.

8. The engine according to claim 6, wherein an energizing member housing part for housing the operation energizing member is formed on the same side of the plunger as the side on which the stem abutment face is formed in a movement direction of the plunger; and a stem communication hole via which the energizing member housing part and the stem housing part communicate with each other is provided in a position overlapping the stem abutment face in the movement direction.

9. The engine according to claim 1, wherein the holder is pressed via a rocker arm which swings by being pressed by the valve drive cam, and reciprocates in the direction of opening/closing the valve.

10. The engine according to claim 2, wherein the holder is pressed via a rocker arm which swings by being pressed by the valve drive cam, and reciprocates in the direction of opening/closing the valve.

11. The engine according to claim 1, wherein the holder is disposed in a bottomed cylindrical valve lifter, thereby constructing the valve stopping mechanism; and the valve lifter is pressed by the valve drive cam so as to reciprocate in the direction of opening/closing the valve together with the holder.

12. The engine according to claim 2, wherein the holder is disposed in a bottomed cylindrical valve lifter, thereby constructing the valve stopping mechanism; and the valve lifter is pressed by the valve drive cam so as to reciprocate in the direction of opening/closing the valve together with the holder.

13. The engine according to claim 3, wherein the holder is disposed in a bottomed cylindrical valve lifter, thereby constructing the valve stopping mechanism; and the valve lifter is pressed by the valve drive cam so as to reciprocate in the direction of opening/closing the valve together with the holder.

14. The engine according to claim 5, wherein the holder is disposed in a bottomed cylindrical valve lifter, thereby constructing the valve stopping mechanism; and the valve lifter is pressed by the valve drive cam so as to reciprocate in the direction of opening/closing the valve together with the holder.

15. The engine according to claim 7, wherein the holder is disposed in a bottomed cylindrical valve lifter, thereby constructing the valve stopping mechanism; and the valve lifter is pressed by the valve drive cam so as to reciprocate in the direction of opening/closing the valve together with the holder.

16. The engine according to claim 1, wherein the switching member includes a spool groove and a land formed along a length thereof, and depending on a position of the switching member in the spool hole, a flow of hydraulic fluid between an inlet port and an outlet port via the spool hole is either permitted or is interrupted.

17. An engine comprising:

a valve provided for a cylinder head of the engine;

a valve energizing member for energizing the valve in the direction of closing the valve;

a valve drive cam rotated in correspondence with rotation of a crankshaft of the engine;

a valve stopping mechanism operatively provided between the valve drive cam and the valve and, on the basis of a stop hydraulic fluid pressure supplied from outside and an operation energizing member for generating an energizing force against the stop hydraulic fluid pressure, selectively generating an operating state of opening/closing the valve in response to an operation of the valve drive cam and a stop state of holding the valve in a valve closing position irrespective of the operation of the valve drive cam, the valve stopping mechanism includes:

a plunger capable of moving orthogonally to a length of the valve in one direction to an operating position to open/close the valve, and in an opposite direction to a stop position to hold the valve in the valve closing position; and a stop hydraulic fluid pressure supply controller for controlling the supply of the stop hydraulic fluid pressure;

wherein the valve stopping mechanism generates the operating state when the energizing force of the operation energizing member is larger than the press force of the stop hydraulic fluid pressure, and generates the stop state when the press force of the stop hydraulic fluid pressure is larger than the energizing force of the operation energizing member; and the stop hydraulic fluid pressure supply controller includes:

a valve body;

a switching member movable in an axial direction within the valve body between a hydraulic fluid supply position in which a pressure source path is connected to a pressure source for supplying the stop hydraulic fluid pressure and a stop pressure supply path for supplying the stop hydraulic fluid pressure to the valve stopping mechanism are communicated with each other, and a hydraulic fluid discharging position for closing the pressure source path and making the stop pressure supply path communicated with a drain side;

a switching energizing member applying a force at one end of the switching member for energizing the switching member to move to a hydraulic fluid supply position side; and a switching pressure supply control mechanism for applying a pressure force at an opposite one end of the switching member to move the switching member to a hydraulic fluid discharge position side, the switching pressure supply control mechanism being attached to an upper part of the valve body and includes a solenoid in a position offset relative to an axis of the switching member.

18. The engine according to claim 16, wherein the switching member includes a spool groove and a land formed along a length thereof, and depending on a position of the switching member in the spool hole, a flow of hydraulic fluid between an inlet port and an outlet port via the spool hole is either permitted or is interrupted.

19. An engine comprising:

a valve provided for a cylinder head of the engine;

a valve energizing member for energizing the valve in the direction of closing the valve;

a valve drive cam rotated in correspondence with rotation of a crankshaft of the engine;

a valve stopping mechanism operatively provided between the valve drive cam and the valve and, on the basis of a stop hydraulic fluid pressure supplied from outside and an operation energizing member for generating an energizing force against the stop hydraulic fluid pressure, selectively generating an operating state of opening/closing the valve in response to an operation of the valve drive cam and a stop state of holding the valve in a valve closing position irrespective of the operation of the valve drive cam, the valve stopping mechanism includes:

a holder reciprocated in the direction of opening/closing the valve by the valve drive cam, the holder having a plunger hole which extends orthogonally to a length of the valve and which is open at one end and closed at an opposite end;

a plunger inserted into plunger hole of the holder and being capable of moving in one direction to an operating position to open/close the valve in accordance with a reciprocating operation of the holder, and in an opposite direction to a stop position to hold the valve in the valve closing position regardless of the reciprocating operation of the holder; and a stop hydraulic fluid pressure supply controller for controlling the supply of the stop hydraulic fluid pressure;

wherein the valve stopping mechanism generates the operating state when the energizing force of the operation energizing member is larger than the press force of the stop hydraulic fluid pressure, and generates the stop state when the press force of the stop hydraulic fluid pressure is larger than the energizing force of the operation energizing member; and the stop hydraulic fluid pressure supply controller includes:

a valve body having a spool hole, a first bypass which communicates with one end of the spool hole, and a second bypass which communicates with an opposite end of the spool hole;

a switching member movable within the spool hole between a hydraulic fluid supply position in which a pressure source path is connected to a pressure source for supplying the stop hydraulic fluid pressure and a stop pressure supply path for supplying the stop hydraulic fluid pressure to the valve stopping mechanism are communicated with each other, and a hydraulic fluid discharging position for closing the pressure source path and making the stop pressure supply path communicated with a drain side;

a switching energizing member applying a force at one end of the switching member for energizing the switching member to move to a hydraulic fluid supply position side; and a switching pressure supply control mechanism for applying a pressure force at an opposite end of the switching member to move the switching member to a hydraulic fluid discharge position side, wherein the switching pressure supply control mechanism is attached to the valve body in a position offset relative to an axis of the spool hole, and includes a poppet which is capable of alternatively opening and closing an open/close hole disposed between the first bypass and the second bypass, thereby allowing or preventing a flow of hydraulic fluid from the one end of the spool hole to the opposite end of the spool hole.

20. The engine according to claim 19, wherein the switching member includes a spool groove and a land formed along a length thereof, and depending on a position of the switching member in the spool hole, the flow of hydraulic fluid between an inlet port and an outlet port via the spool hole is either permitted or is interrupted.

21. The engine according to claim 19, wherein the first bypass extends in a direction parallel to the axis of the spool hole, and the second bypass extends in a direction which is diagonal relative to the axis of the spool hole.

* * * * *